US011939125B2

(12) United States Patent
Bartolomé Gombau

(10) Patent No.: US 11,939,125 B2
(45) Date of Patent: Mar. 26, 2024

(54) TETHERED CLOSURE SYSTEM

(71) Applicant: CLOSURE SYSTEMS INTERNATIONAL ESPAÑA, S.L.U., Sant Cugat de Sesgarrigues (ES)

(72) Inventor: Francisco Javier Bartolomé Gombau, Llinars del Vallès (ES)

(73) Assignee: CAP SUSTAINABLE SOLUTIONS, S.L.U., Sant Cugat Sesgarrigues (ES)

( * ) Notice: Subject to any disclaimer, the term of this patent is extended or adjusted under 35 U.S.C. 154(b) by 0 days.

(21) Appl. No.: 18/279,332

(22) PCT Filed: Feb. 23, 2022

(86) PCT No.: PCT/EP2022/054566

§ 371 (c)(1),
(2) Date: Aug. 29, 2023

(87) PCT Pub. No.: WO2022/184528

PCT Pub. Date: Sep. 9, 2022

(65) Prior Publication Data

US 2024/0034527 A1 Feb. 1, 2024

(30) Foreign Application Priority Data

Mar. 3, 2021 (EP) ..... 21382177

(51) Int. Cl.
*B65D 55/16* (2006.01)
*B65D 1/02* (2006.01)
(Continued)

(52) U.S. Cl.
CPC ..... *B65D 55/16* (2013.01); *B65D 1/0246* (2013.01); *B65D 41/3447* (2013.01); *B65D 51/242* (2013.01); *B65D 2401/30* (2020.05)

(58) Field of Classification Search
CPC .. B65D 55/16; B65D 1/0246; B65D 41/3447; B65D 51/242; B65D 2401/03
(Continued)

(56) References Cited

U.S. PATENT DOCUMENTS 3,904,062 A 9/1975 Grussen
2021/0039840 A1* 2/2021 Benoit-Gonin ..... B65D 1/0246

FOREIGN PATENT DOCUMENTS

CH 715 478 A1 4/2020
CN 1631740 A 6/2005
(Continued)

OTHER PUBLICATIONS

European Search Report for EP 21382177.0 dated Sep. 14, 2021.
(Continued)

*Primary Examiner* — Valentin Neacsu
*Assistant Examiner* — Eric C Baldrighi
(74) *Attorney, Agent, or Firm* — Sughrue Mion, PLLC

(57) ABSTRACT

A closure system having a container neck portion and a closure both with tread formations offering multiple angular distributed mutual engagement options. The closure has a closure shell and a tamper-evident band connected through frangible connections that break when the closure shell is fully unengaged for the first time forming an unattached tether. The tamper-evident band and a lodging section of the container neck portion are configured to provide for a strong grip between them, so as to impede the free rotation of the tamper-evident band during the first and subsequent opening operations of the container neck portion, and specific optimal sizing for the tether are selected, such that the closure system offers the user different re-closing options, at least one of which forces the tether to adopt an exposed state determining a protruding handle.

10 Claims, 3 Drawing Sheets

(51) Int. Cl.
*B65D 41/34* (2006.01)
*B65D 51/24* (2006.01)

(58) Field of Classification Search
USPC ..... 220/44
See application file for complete search history.

(56) References Cited

FOREIGN PATENT DOCUMENTS

| | | | | | |
|---|---|---|---|---|---|
| CN | 208264903 | U | | 12/2018 | |
| EP | 3 584 190 | A1 | | 12/2019 | |
| FR | 3084881 | A1 | * | 2/2020 | ..... B65D 41/3442 |
| WO | 02/44050 | A1 | | 6/2002 | |
| WO | 2020/099199 | A1 | | 5/2020 | |
| WO | 2020/182854 | A1 | | 9/2020 | |

OTHER PUBLICATIONS

International Search Report for PCT/EP2022/054566 dated May 20, 2022.
Written Opinion for PCT/EP2022/054566 dated May 20, 2022.

* cited by examiner

TETHERED CLOSURE SYSTEM

CROSS REFERENCE TO RELATED APPLICATIONS

This application is a National Stage of International Application No. PCT/EP2022/054566 filed Feb. 23, 2022, claiming priority based on European Patent Application No. 21382177.0 filed Mar. 3, 2021.

FIELD OF THE INVENTION

The invention relates to a closing system combining a threaded closure and a matching container threaded neck portion, defining a container opening, to reversibly close the said container opening.

The closure is of the type having a bottom tamper-evident band originally linked to a closure shell of the closure through frangible connections. When the closure shell is unscrewed for the first time to uncover the container opening, the frangible connections break forming an unattached tether preventing the closure shell and the tamper-evident band to form two separated individual components.

BACKGROUND OF THE INVENTION

The patent document U.S. Pat. No. 3,904,062 describes a closure system consisting of a screw closure provided with a tamper-evident band that remains axially retained in a container neck portion when the closure is unscrewed from the said container neck portion. The tamper-evident band is originally connected to the main body of the closure along frangible connections that are broken during a first opening operation of the container determining a tether that links the unscrewed main body of the closure to the tamper-evident band, which remains anchored to the container neck portion.

On the one hand, the rupture of the frangible connections indicates to a user that the contents of the container may have been accessed.

On the other hand, the tether prevents the unscrewed closure main body and the tamper-evident band, and therefore the container, to form two separated individual components. In other words, it prevents or inhibits the closure shell main body from being separated from the container. This favours the recycling of the container along with the complete closure parts.

The patent document EP3584190 describes a closure system with some common features with that described in the previous reference. More specifically, the closure of EP3584190 comprises a closure shell having an annular skirt portion with first and second frangible connections that partially detachably connect the annular skirt portion with a tamper-evident band. When the frangible connections are broken a tether is exposed with one end attached to the annular skirt portion and with its opposite end attached to the tamper-evident band. In the system of EP3584190 the frangible connections are configured for the tether to extend greater than about 300 degrees around the circumference of the closure. According to EP3584190, by having the unattached portion of the tether extending greater than about 300 degrees, the distance of the closure shell from the container neck portion to which the tamper-evident band is anchored is increased, eliminating or reducing the chances of the closure shell from interfering with a user while drinking or pouring the content of the container.

In principle, a long tether connecting in captive fashion the closure shell of the closure to the tamper-evident band would favor positioning the unscrewed closure shell of the closure moved away from the container opening region without the risk of the said closure shell accidentally reaching across the cross-section of the container opening, for example, when the container is tilted. In practice, however, the exposed tether is affected by a memory effect that makes it to naturally adopt a curved shape (due to the original circumferential arch shape that the strip of material, that later will determine the tether, has in the manufactured closure). As a result, the tether, conventionally made of plastic, performs like a sort of a spring slightly biasing the closure shell towards the container opening.

It is for this reason that other technical solutions are presently preferred to prevent the unscrewed closure shell and the tamper-evident band, and therefore the container, to form two separated individual components.

The patent documents WO2020099199 and WO2020182854 describe alternative technical solutions, aiming at indicating to a user that the contents of the container may have been accessed and preventing an unscrewed closure shell and an associated tamper-evident band to form two separated individual components. The cited proposals avoid the formation of a single long tether when the closure shell is unscrewed for the first time and provide a short tether, or a pair of opposite short tethers, to function as a hinge like means to hold the unscrewed closure shell in a secure position out of the container opening projection.

It is a main objective of the present invention to provide an alternative solution to those disclosed in the prior art.

The patent document CN1631740 relates to a safety bottle cap including the cap body and a safety ring linked under the body. It is of interest that there is a flexible permanent tether linking the cap body with the safety ring, this tether being over dimensioned to form a carrying handle, at least for the fingers to insert and pick up. This cap has advantages such as providing a safe seal, convenient environmental protection and in this case also easy carrying features.

It is a further objective of the present invention the provision of a solution favoring the easy carrying of the container.

It is however desirable an easy carrying solution activable or operable only once the container has been opened for the first time. It is to be avoided the provision of a permanent handle as in the proposal according to CN1631740, that could create handling problems during the containers manufacturing process, for example during the first coupling of the closures to the containers, during the transport of the already manufactured containers and during the storing and distribution of the same.

SUMMARY OF THE INVENTION

The proposed closure system is described in the claim 1.

The proposed closure system combines a pair of a closure and a container neck portion with mating threaded formations offering multiple angular distributed engagement options with a tamper-evident band prevented from rotating around a lodging section of the said neck portion, whereby an optimal sizing of the tether will offer the user different closing options, at least one of which will force the tether to adopt an exposed state determining a protruding handle.

In a specific embodiment of the closure system, the container neck portion, defining a container opening with a central axis, is provided with an external thread formation including a reference finish lead and at least a first and a second auxiliar finish leads in a counterclockwise order, and an external shoulder beneath said external threaded formation.

The closure comprises a closure shell with a top wall portion and an annular skirt portion provided with an internal thread formation mating with the external thread formation of the neck portion and including a reference closure lead and at least a first and a second auxiliar closure leads in a counterclockwise order.

The closure shell further comprises an annular tamper-evident band dimensioned to remain engaged beneath the external shoulder and around a lodging section of the neck portion, and a connecting strip encircling the closure shell between the annular skirt portion and the tamper-evident band, having an upper edge attached to the annular skirt and a lower edge attached to the tamper-evident band along respective upper and lower frangible connections that overlap along at least D1 degrees around the closure shell in a manufactured closed state A of the container opening in which the reference finish lead and the reference closure lead are engaged each other, whereby the complete unscrew of the closure shell during a first opening operation of the container's opening starting from the said manufactured closed state A results in rupture of the upper and the lower frangible connections the connecting strip then forming an unattached tether linking the unscrewed closure shell with the container neck portion.

Essentially, this closure system is characterized in that D1 is from 150 to 350; in that the length of the unattached tether is from 37 mm to 125 mm, and in that the tamper-evident band and the lodging section of the neck portion are configured to provide for a strong grip between them so as to impede the free rotation of the tamper-evident band during the first and subsequent opening operations of the container opening, such that when the closure shell is screwed on to the container neck portion during a re-closing operation of the container's opening by engaging the reference closure lead of the closure shell with the first auxiliary finish lead, instead of engaging it with the reference finish lead of the container neck portion, the tether adopts an exposed state B1 determining a protruding handle.

Advantageously, the same tether that prevents the closure shell from being separated from the container offers for a protruding handle in case the user be in necessity thereof. At the same time, the system always offers a coupling option to re-close the container wherein the tether will adopt its initial form adjacent and encircling the closure shell without protruding.

Far from being deterred from choosing a long tether, the inventors have realized the advantages that a long tether can offer when combined with a pair of a closure shell and a container neck portion with mating threaded formations offering multiple angular distributed engagement options.

The inventors have also revealed that by making use of the tether as a handle, the tether adopts a different shape when the closure shell is completely unscrewed from the container neck portion in a subsequent opening operation.

Having the tether previously been subjected to pulling forces in a direction with a strong axial component when used as a handle, in the subsequent opening operation the tether adopts a shape that favors the arrangement of the closure shell outside the projection of the container opening, which is desirable and advantageous.

To facilitate the user to re-close the container so that the tether adopts an exposed state determining a protruding handle, in an embodiment of the invention, D1 is selected enough to provide for at least two re-closing options wherein the tether adopts respective different exposed states, specifically enabling a re-closing operation of the container opening by engaging the reference closure lead of the closure shell with any of the first and the second auxiliary finish leads of the container neck portion, the tether transversally protruding more in the latter case.

The invention envisages that the closure shell and the tamper-evidence band incorporate visual indications to provide the user with visual references

- to face the closure shell and the container neck portion to screw on the closure shell during a re-closing operation of the container opening by mutually engaging the reference closure and finish leads, and
- to face the closure shell and the container neck portion to screw on the closure shell during a re-closing operation of the container opening by mutually engaging the reference closure lead with at least one of the first or the second auxiliar finish leads.

In one embodiment, being the mating external and internal thread formations configured such that the closure shell has to be rotated R1 degrees about the central axis to fully screw on the said closure shell to the container neck portion, D1 is approximately equal than R1.

The invention envisages that in a set formed by the reference closure lead and the auxiliar closure leads, all the leads are regularly phased shifted with respect to the central axis.

In one embodiment, the internal thread formation has a number of three leads regularly phased shifted with respect to the central axis: the reference closure lead, a first auxiliar closure lead and second auxiliar closure lead. Preferably then, D1 is equal or greater than R1, being D1 also greater than 240.

Other features and associated benefits are described in the description that follows.

DETAILED DESCRIPTION

Figure 1A:
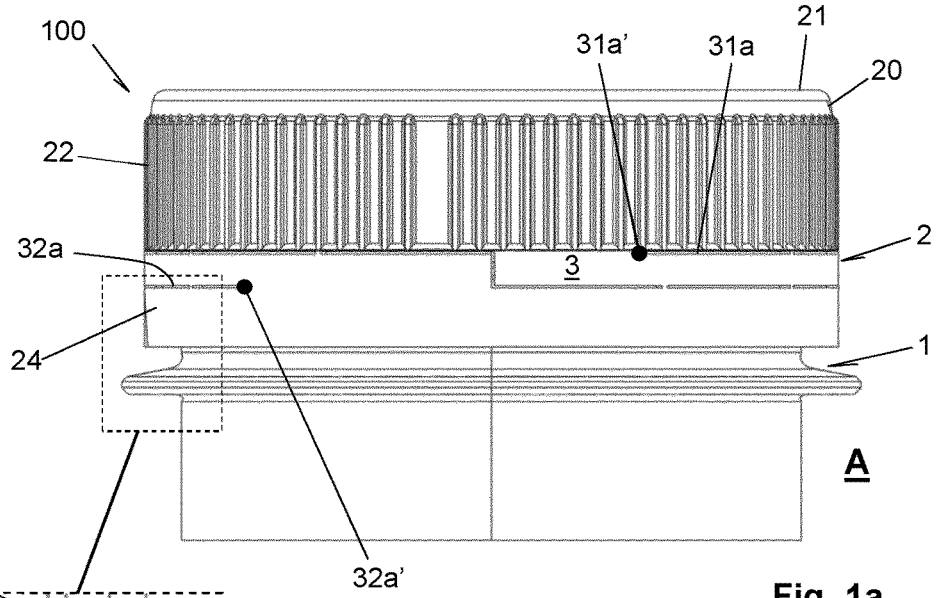
FIG. 1*a* is an elevation view of a coupling system according to an embodiment of the invention, particularly showing a container neck portion and a closure in a manufactured closed state A of a container opening.

The drawings exemplify a closure system according to the invention. This closure system 100 comprises a polymeric closure 2 and a container neck portion 1 mutually engageable.

The container neck portion 1, that defines a container opening 11 with a central axis 12, is provided with external threaded coupling means 13 and with an external shoulder 14 beneath said external threaded coupling means 13. The container can be made of a polymeric material and shaped as a bottle, such as a typical portable bottle storing a liquid product with a capacity of 1 liter.

The closure 2 is of the type made of one-piece of polymeric material and is generally cylindrically shaped. The closure 2 has a closure shell 20, having a top wall portion 21 and an annular skirt portion 22 provided with internal threated coupling means 23 mating with the external threaded coupling means 13 of the neck portion 1; and a bottom annular tamper-evident band 24.

FIG. 1*a* shows the closure system 100 in a manufactured closed state A of the container opening. The FIG. 1*a* is complemented with the detailed cross-sectional view of the FIG. 1*b*.

Figure 1B:
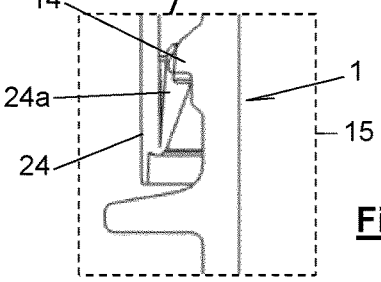
FIG. 1*b* is a cross-sectional view, according to a diametrical section plane, of the framed portion of the closure of the FIG. 1.

As shown in the said FIG. 1*b*, the annular tamper-evident band 24 is dimensioned to be anchored beneath the shoulder 14 and around a lodging section of the neck portion 1. This measure provides for a future axial retention of the tamper-evidence band 24 towards the container opening. To that effect, the tamper-evident band 24 may have an internal profile with a continuous flange 24*a* or with discrete protrusions that, when the closure is first screwed on to close the container opening a snap engagement is established between the flange, or protrusions, of the annular tamper-evident band 24 and the shoulder 14 of the container neck portion 1. These flange or protrusions may offer, for example, an introducing cam surface terminating in a flat engagement surface preferably perpendicular or essentially perpendicular to the central axis 12. The cam surface can be provided in an elastically deformable portion of the tamper-evident band 24. This is the case of the continuous flange 24 in the exemplary embodiment of the FIG. 2*b*.

As shown in the FIG. 1*a*, the annular skirt portion 22 of the closure shell 20 has, in a manufactured closed state A of the container opening, a connecting strip 3 encircling the closure shell 20 between the annular skirt portion 22 and the tamper-evident band 24, the strip 3 having an upper edge 31 attached to the annular skirt portion along an upper frangible connection 31*a* and a lower edge 32 attached to the tamper-evident band along a lower frangible connection 32*a*. These frangible connections are intended to be broken when the closure shell 20 is unscrewed for the first time.

Figure 3A:
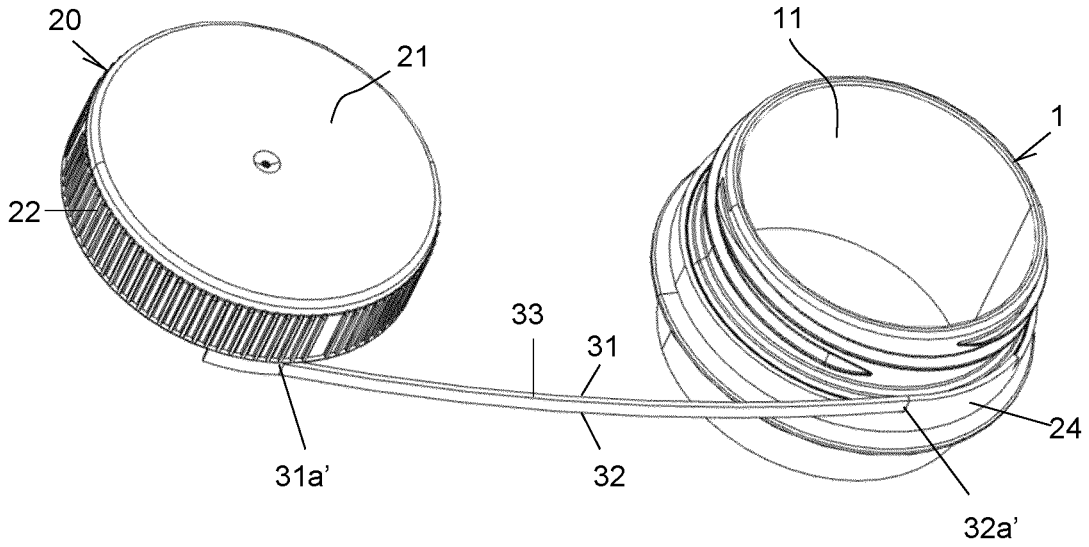
FIGS. 3*a* and 3*b* are perspective and elevation views, respectively, showing the same coupling system after a closure shell of the closure has been unscrewed and frangible connections provided therein have been broken determining an unattached tether.

Specifically, the unscrew of the closure shell 20 during a first opening operation of the container opening starting from the manufactured closed state A displaces the annular skirt portion 22 upwards while the tamper-evident band 24 is axially retained in the container neck portion 1 and this results in rupture of the upper and the lower frangible connections 31*a*, 31*b*, the connecting strip 3 forming then the unattached tether 33. This tether 33 is showed in the FIGS. 3*a* and 3*b*.

The upper and the lower frangible connections 31*a*, 31*b* can be implemented by way of scoring lines, notches, leaders, lines of weaknesses, rows of pins, etc, formed (for example, moulded by sliders) or practiced (for example, laser scored) in the material conforming the closure shell 20, which can be selected, for example, from high density polyethylene (HDPE), polyethylene (PE), polypropylene (PP), Polyethylene terephthalate (PET) or blends thereof.

Figure 3B:
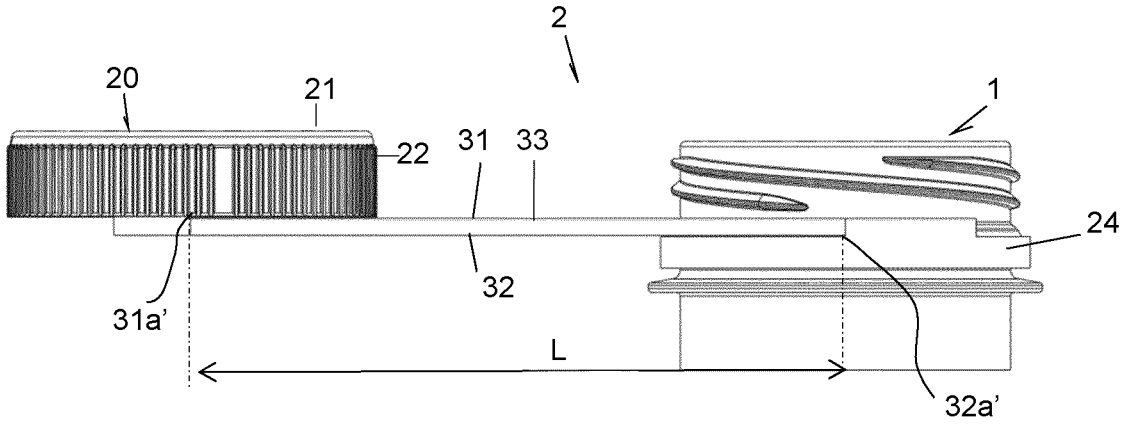

The FIG. 3*b* particularly shows how the practical length L of the tether 33 is determined by the overlapping length of the upper and the lower frangible connections 31*a*, 32*a*. This length L will be conditional to the distance between the proximal end 31*a*' of the upper frangible connection 31*a*, adjacent to the permanent connection of the tether 33 with the annular skirt portion 22, and the proximal end 32*a*' of the lower frangible connection 32*a*, adjacent to the permanent connection of the tether 33 with the tamper-evidence band 24, as illustrated in the FIG. 3*b*.

Certainly, the upper and the lower frangible connections 31*a*, 32*a* overlap along D1 degrees around the closure shell in a manufactured closed state A of the closure system 100. As will be explained in more detail hereinafter, the invention envisages dimensioning D1 to be greater than 150.

Figure 2A:
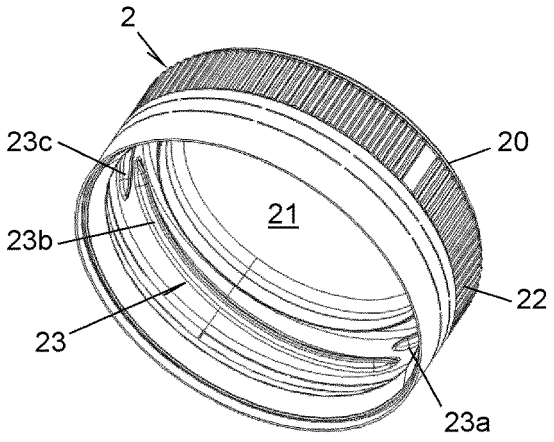
FIGS. 2*a* and 2*b* are perspective views of the closure and of the container neck portion, respectively, before their first mutual engagement.
Figure 2B:
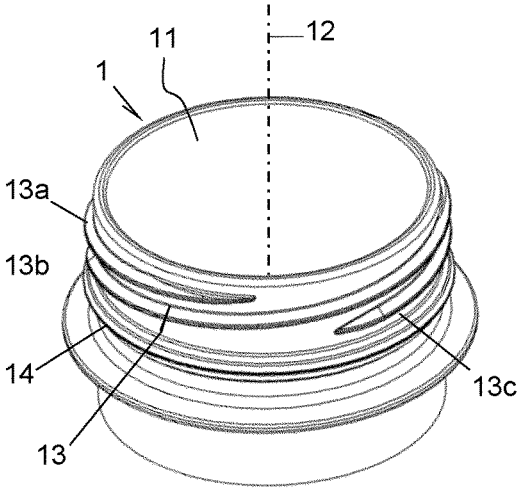

Regarding the mating external and internal thread formations 13 and 23, respectively, which can be identified in the FIGS. 2*a* and 2*b*, the closure system 100 deploys its potential when they include at least three leads each, in combination to a specific engagement of the tamper-evident band 24 in the lodging section 15 of the neck portion 1 and a proper selection of D1, preferably for a specific range of diameter dimensions of the closure 2, which in turn give rise to specific lengths L for the tether 33.

Figure 4A:
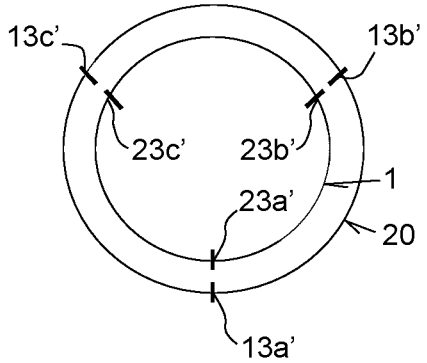
FIGS. 4*a* to 4*c* are simplified schematic views of a set formed by a container neck portion and a closure shell, in each figure adopting different relative positions, wherein reference finish and closure leads beginning points as well as first and second auxiliar finish and closure leads beginning points have been identified and properly labelled.
Figure 4B:
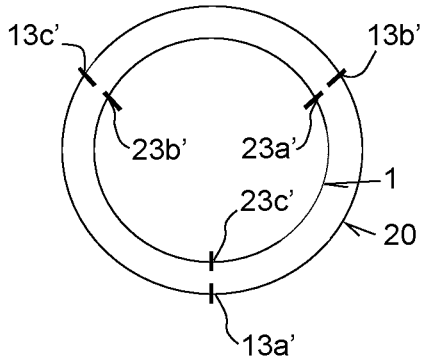
Figure 4C:
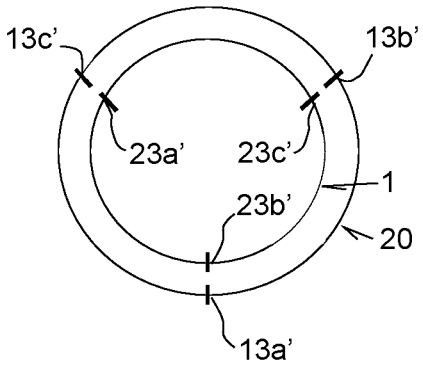

In the embodiment exemplifying the invention, the external thread formation 13 has a number of three finish leads having respective beginning points, in the proximity of the opening edge of the container opening neck 1, located roughly 120 degrees apart from each other: a reference finish lead 13*a* with a beginning point 13*a*', a first auxiliar finish lead 13*b* with a beginning point 13*b*' and a second auxiliar finish lead 13*c* with a beginning point 13*c*', beginning points identified and properly labelled in the schemes of the FIGS. 4*a* to 4*c*.

In correspondence with the external thread formation 13 of the container neck portion 1, the internal thread formation 23 of the annular skirt portion 22 of the closure shell 20 includes a reference closure lead 23*a* and at least a first and a second auxiliar closure leads 23*b*, 23*c* in the counterclockwise order.

In the embodiment exemplifying the invention, the internal thread formation 23 has a number of three closure leads having respective beginning points, in the proximity of the strip 3, also located roughly 120 degrees apart from each other: a reference closure lead 23*a* with a beginning point 23*a*', a first auxiliar closure lead 23*b* with a beginning point 23*b*' and a second auxiliar closure lead 23*c* with a beginning point 23*c*', beginning points identified and properly labelled as well in the schemes of the FIGS. 4*a* to 4*c*.

Despite the drawings show continuous leads, it is envisaged to opt for discrete or discontinuous leads.

It is a characterizing feature of the closure system 100 that the tamper-evident band 24 and the lodging section 15 of the neck portion 1 are configured to provide for a strong grip between them so as to impede the free rotation of the tamper-evident band 24 during the first and subsequent opening operations of the container opening. That is, not only the shoulder 14 of the container neck portion 1 provides for an axial retention of the tamper-evident band 24 but also the said tamper-evident band 24 and the lodging section 15 of the container neck portion 1, which includes the abovementioned shoulder 14, mechanically interfere each other to impede the free rotation of the tamper-evident band 24 relative to the container neck portion 1.

This anti-rotation effect can be achieved simply by friction. It is also envisaged to provide the lodging section 15, including the shoulder 14, and/or the tamper-evident band 24 with anchoring means or anti-return means, stoppers, or the like, blocking the movement of the tamper-evident band 24 al least in the counterclockwise direction.

Dimensioning the inner cross section of the annular tamper-evident band 24 to be less than that of the outer cross section of the lodging section 15 may be sufficient, taking advantage of the elastic properties offered by the candidate materials to manufacture the closure, which can be elastically deformed during a first coupling of the closure to the container neck portion, so that the tamper-evident band 24 be pressed tightly around the said lodging section 15 through restoring forces. This tightly adjustment is provided, in the exemplary embodiment of the invention, by the elastically deformable continuous flange 24*a* formed in the tamper-evident band 24.

To exemplify the invention, it has been selected an embodiment of the invention wherein D1 is 270; the length L of the tether 33 is 94 mm (corresponding to a closure 2 of about 38 mm diameter); and the set of leads, either of the external thread formation 13 or of the internal thread formation 23, extend in a helical fashion and are configured to have to rotate the closure shell 20 R1 degrees about the central axis 12, to unscrew or screw it completely, wherein R1 is 200.

The operation of this embodiment is the following:

In the referred manufactured closed state A the reference finish lead 13*a* and the reference closure lead 23*a* are the ones engaged each other.

When the closure shell 20 is unscrewed about 200 degrees anticlockwise to reveal the container opening the upper and the lower frangible connections 31*a* and 32*a* break and the tether 33 is exposed when the closure shell 20 is removed from the container neck portion 1 thus opening the container.

It is worth mentioning that, because of the strong grip provided between the tamper-evident band 24 and the lodging section 15 of the container neck portion 1 impedes the free rotation of the former in respect of the latter, the proximal end 32*a*' of the lower frangible connection 32*a*, and therefore the point from which the tether 33 extends, remains static relative to the container neck portion 1.

To re-close the container opening, the user is offered three options.

i) If the user engages again the reference finish lead 13*a* with the reference closure lead 23*a* (facing the closure shell 20 and the container neck portion 1 as shown in the FIG. 4*a*) and the closure shell is screwed on about 200 degrees clockwise, the tether 33 will naturally adopt the original strip 3 form surrounding the closure shell 20, held adjacent to the container neck portion 1, without protruding outwards.

Figure 5A:
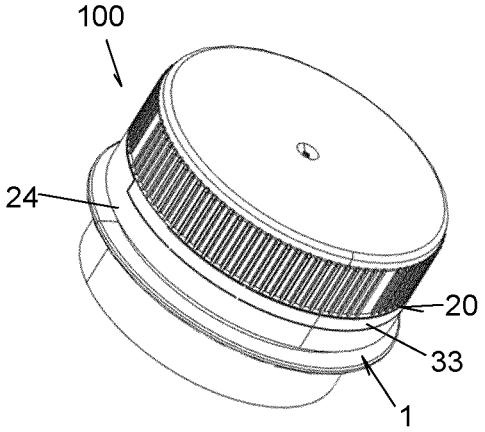
FIGS. 5*a* to 5*c* are perspective views of the closure system being the closure shell screwed on for reclosing the container opening by engaging the reference closure lead of the closure shell with i) the reference finish lead, ii) the first auxiliar finish lead and iii) the second auxiliar closure finish lead, respectively, of the container neck portion, in correspondence with the simplified schematic views of the FIGS. 4*a* to 4*c*.

This non-protruding state of the tether 33 is shown in the FIG. 5*a*.

ii) If the user does not engage again the reference closure lead 23*a* with the reference finish lead 13*a* but with the first auxiliar finish lead 13*b* (facing the closure shell 20 and the container neck portion 1 as shown in the FIG. 4*b*) and the closure shell is screwed on about 200 degrees clockwise, the tether 33 will naturally adopt a first exposed state B1, determining a protruding handle.

This is because, while the point from which the tether 33 extends remains static relative to the container neck portion 1, the proximal end 31*a*' of the upper frangible connection 31*a*, and therefore the point from which the tether 33 extends from the closure shell 20, will terminate at a closer position to the point from which the tether 33 extends from the container neck portion 1, approximately 120 degrees closer in comparison to the option i), which means that the opposite ends of the tether 33 will be at 150 degrees each other with respect to the central axis 12.

Figure 5B:
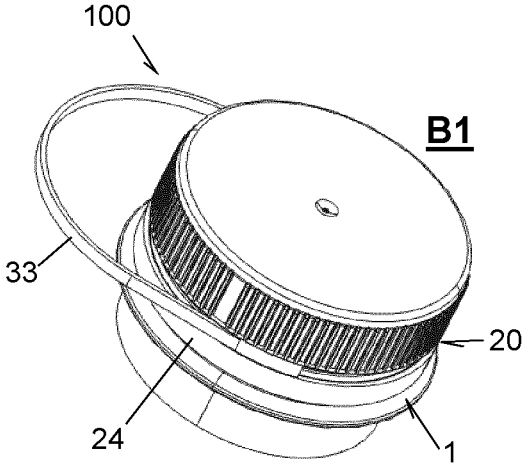

This first exposed state B1 of the tether 33 is shown in FIG. 5*b*.

iii) If the user does not engage again the reference closure lead 23*a* with the reference finish lead 13*a* but with the second auxiliar finish lead 13*c* (facing the closure shell 20 and the container neck portion 1 as shown in the FIG. 4*b*) and the closure shell is screwed on about 200 degrees clockwise, the tether 33 will naturally adopt a second exposed state B2, determining a more elongated protruding handle.

In this case, the point from which the tether 33 extends from the closure shell 20 will terminate approximately 240 degrees closer than before, we mean, in comparison to the option i). The opposite ends of the tether 33 will be at 30 degrees each other in respect of the central axis 12.

Figure 5C:
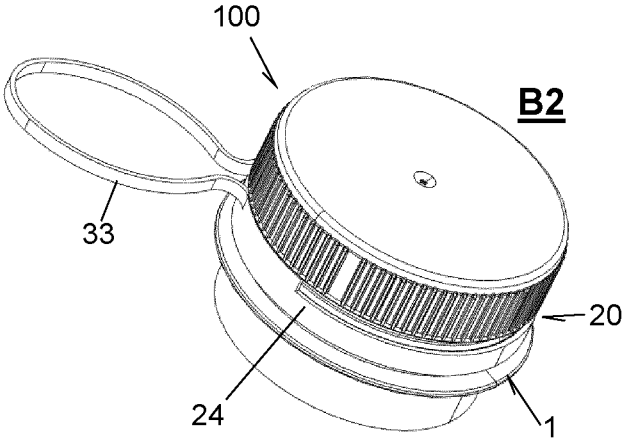

This second exposed state B2 of the tether 33 is shown in FIG. 5*c*.

As the reader will have noticed, this third option would only be possible if the value for D1 is greater than 240.

This is due to the fact that, to re-close the container by selecting any of the options ii) and iii), it will be necessary to first counterclockwise rotate the closure shell 20 200 degrees to unscrew it and then counterclockwise rotate the closure shell 20 further degrees until the reference closure lead 23*a* of the closure shell 20 is within reach of the first auxiliar finish lead 13*b* or, if applicable, within reach of the second finish lead 13*c* of the container neck portion 1.

Other embodiments of the invention are conceived within the spirit of the present invention.

In this sense, the following Table 1 gives further examples to put into practice a closure system according to the invention. These examples are based on a closure obtained from polyolefins and following a conventional process of compression molding or injection molding with molded bridges or slitting operations.

TABLE 1

Further exemplary embodiments of the closure system according to the invention

| D1 | L (mm) | R1 | Number of leads per thread formation | Appropriate for |
|---|---|---|---|---|
| 150 | 37 | 180 ± 25 | 3 | Plastic bottles with a capacity from about 0.2 L till 5 L (liters) |
| 150 | 52 | 200 ± 25 | | |
| 200 | 49 | 180 ± 25 | | |
| 200 | 70 | 200 ± 25 | | |
| 250 | 61 | 180 ± 25 | | |
| 250 | 87 | 200 ± 25 | | |
| 250 | 87 | 250 ± 25 | | |
| 300 | 74 | 180 ± 25 | | |
| 300 | 105 | 200 ± 25 | | |

TABLE 1-continued

| Further exemplary embodiments of the closure system according to the invention | | | | |
|---|---|---|---|---|
| D1 | L (mm) | R1 | Number of leads per thread formation | Appropriate for |
| 300 | 105 | 250 ± 25 | | |
| 350 | 86 | 180 ± 25 | | |
| 350 | 126 | 200 ± 25 | | |

In all of the above examples, the strip 3, subsequently determining the tether 33, preferably have a minimum cross section of 1.5 $mm^2$, and more preferably of 2 $mm^2$.

The set of leads, for both the external thread formation 13 and the internal thread formation 23, extend in a helical fashion but, as indicated above, they can be configured to have to rotate the closure shell 20 different R1 degrees about the central axis 12 to be fully unscrewed or screwed on.

As one can notice, D1 is always below 351. The upper and the lower frangible connections 31*a* and 32*a* cannot overlap along the entire circumference of the closure shell 20, specifically along the entire circumference of the annular skirt portion 22. In all cases the upper frangible connection 31*a* will extend around the circumference of the closure shell 20 except in the area that eventually forms the permanent attachment of the tether 33 to the closure shell 20; and the lower frangible connection 32*a* will extend around the circumference of the closure shell except in the area that eventually forms the permanent attachment of the tether 33 to the tamper-evidence band 24. Preferably, these permanent attachments extend at least along 5 degrees each about the central axis 12. Most preferably these permanent attachments extend at least along 10 degrees each about the central axis 12. It is not necessary that these permanent attachments to the closure shell 20 and to the tamper-evident band 24 extend each along the same degrees.

In the example of the drawings, the upper and the lower frangible connections 31*a* and 32*a* are parallel each other, determining a strip 3 and a subsequent unattached tether 33 of a constant width along its length L. However, it is conceived to give to at least one or to both the upper and the lower frangible connections 31*a* and 32*b* a non-straight profile, for example, to increase the width of the tether 33 at a central portion thereof to improve the comfort of the handle.

Among the most suitable combinations of D1 and L, it is particular advantageous that in which D1 is approximately equal the R1 degrees the closure shell 20 has to be rotated about the central axis 12 to be fully unscrewed and screwed on, because this gives the user a visual indication to engage again the reference finish lead 13*a* with the reference closure lead 23*a*, opting for re-closing according to the i) option, previously described. This visual indication it is no other than the coincidence of the two opposing ends of the tether 33. When the said opposed ends of the tether are axially aligned the reference finish lead 13*a* and the reference closure lead 23*a* will be engageable.

In the context of the present invention, D1 would be considered approximately equal to R1 when D1−R1=±15.

Among the most suitable combinations of D1 and L, it is also particular advantageous that in which D1 is greater than R1 and D1>240 degrees when the number of leads per thread formation is three, distributed 120 degrees from form each other.

In any case, it is conceived to incorporate visual indications in both the closure shell 20 and the tamper-evident band 24 to provide the user with visual refences of how to screw on the closure shell 20 in a re-closing operation leading to the option i) or to any of the further possible options (depending on the number of auxiliar finish and closure leads).

These visual indicators may be simple reliefs formed on the body of the closure shell 20 and the tamper-evidence band 24. This reliefs may include numbers, strips, dots, geometric shapes, arrows, etc. or a combination thereof.

The invention claimed is:

1. A closure system comprising a container neck portion and a closure both with thread formations offering multiple angular distributed mutual engagement options to close the container neck portion, wherein the closure has a closure shell and a tamper-evident band connected through frangible connections that break when the closure shell and the container neck portion are fully unengaged for the first time forming an unattached tether, wherein characterized in that being the tamper-evident band anchored at a lodging section of the container neck portion the tamper-evident band and the said lodging section are further configured to provide for a strong grip between them, so as to impede the free rotation of the tamper-evident band during the first and subsequent engagement operations of the closure shell and the container neck portion, and in that the length of the tether is such that the closure system offers the user different re-closing options, one in which the tether adopts a position encircling adjacent the container neck portion, without protruding; and at least one further option in which the tether adopts an exposed state determining a protruding handle; and wherein the container neck portion defines a container opening, with a central axis, and is provided with an external thread formation including a reference finish lead and at least a first and a second auxiliary finish leads in a counterclockwise order; and wherein the closure shell comprises a top wall portion and an annular skirt portion with an internal thread formation mating with the external thread formation of the neck portion and including a reference closure lead and at least a first and a second auxiliary closure leads in a counterclockwise order; and wherein, when the closure shell is screwed on to the container neck portion during a re-closing operation of the container opening by engaging the reference closure lead of the closure shell with the first auxiliary finish lead instead of engaging with the reference finish lead of the container neck portion, the tether adopts an exposed state determining a protruding handle.

2. The closure system according to the claim 1, wherein the container neck portion, is provided with an external shoulder beneath said external thread formation, and wherein the closure, for closing the container opening, comprises an annular tamper-evident band that is dimensioned to remain engaged beneath the external shoulder and around the lodging section of the container neck portion, and a connecting strip encircling the closure shell between the annular skirt portion and the tamper-evident band, having an upper edge attached to the annular skirt portion and a lower edge attached to the tamper-evident band along respective upper and lower frangible connections that overlap along at least D1 degrees around the closure shell in a manufactured closed state of the container opening in which the reference finish lead and the reference closure lead are engaged each other, whereby the complete unscrew of the closure shell during a first opening operation of the container opening starting from said manufactured closed state results in the breaking or rupture of the upper and lower frangible connections, the connecting strip then forming the unattached tether linking the unscrewed closure shell with the container neck portion, and wherein D1 is from 150 to 350 degree, the length of the tether is from 37 mm to 125 mm.

3. The closure system according to the claim 2, wherein D1 is enough to provide for at least two re-closing options wherein the tether adopts respective different exposed states, specifically to enable a re-closing operation of the container opening by engaging the reference closure lead of the closure shell with any of the first and the second auxiliary finish leads of the container neck portion, the tether transversally protruding more in the latter case.

4. The closure system according to claim 2, wherein the closure shell and the tamper-evidence band incorporate visual indications to provide the user with visual references to face the closure shell and the container neck portion to screw on the closure shell during a re-closing operation of the container's opening by mutually engaging the reference closure and finish leads, and to face the closure shell and the container neck portion to screw on the closure shell during a re-closing operation of the container's opening by mutually engaging the reference closure lead with at least one of the first or the second auxiliary finish leads.

5. The closure system according to claim 2, wherein being the mating external and internal thread formations configured such that the closure shell has to be rotated R1 degrees to fully screw on the said closure shell to the container neck portion, D1 is approximately equal to R1.

6. The closure system according to claim 2, wherein in a set formed by the reference closure lead and the auxiliary closure leads, the said leads are regularly phased shifted with respect to the central axis.

7. The closure system according to claim 2, wherein the internal thread formation has a number of three leads regularly phased shifted with respect to the central axis: the reference closure lead, a first auxiliary closure lead and second auxiliar closure lead.

8. The closure system according to claim 7, wherein D1 is greater than 240 degree.

9. The closure system according to any claim 2, wherein being the mating external and internal thread formations configured such that the closure shell has to be rotated R1 degrees to fully screw on the said closure shell to the container neck portion, D1 is greater than R1; and having the internal thread formation a number of three leads regularly phased shifted with respect to the central axis: the reference closure lead, a first auxiliar closure lead and second auxiliary closure lead, D1 is greater than 240 degree.

10. The closure system according to claim 1, wherein a width of the unattached tether is increased at a central portion thereof.

* * * * *